US008595907B2

(12) United States Patent
Katz et al.

(10) Patent No.: US 8,595,907 B2
(45) Date of Patent: Dec. 3, 2013

(54) AESTHETIC BEADED NECKLACE CLASP

(76) Inventors: Michael Katz, Portland, OR (US); Timothy John Lambert, Port Townsed, WA (US)

( * ) Notice: Subject to any disclaimer, the term of this patent is extended or adjusted under 35 U.S.C. 154(b) by 684 days.

(21) Appl. No.: 12/806,269

(22) Filed: Aug. 9, 2010

(65) Prior Publication Data

US 2012/0030914 A1 Feb. 9, 2012

(51) Int. Cl.
*A44C 5/00* (2006.01)

(52) U.S. Cl.
USPC ..... 24/662; 24/128; 24/116 A; 403/56; 403/142; 63/38

(58) Field of Classification Search
USPC ..... 24/664, 116 A, 128; 403/56, 123, 141, 403/142, 143; 446/120; 63/38, 39
See application file for complete search history.

(56) References Cited

U.S. PATENT DOCUMENTS

| | | | | |
|---|---|---|---|---|
| 1,795,674 | A | 3/1931 | Potter | |
| 3,066,501 | A | 12/1962 | Charles | |
| 3,357,204 | A | 12/1967 | Davis | |
| 3,798,711 | A * | 3/1974 | Cousins | 24/196 |
| 5,531,665 | A * | 7/1996 | Chen | 24/116 A |
| 5,554,194 | A * | 9/1996 | Sanders | 403/141 |

* cited by examiner

*Primary Examiner* — Robert J Sandy

(57) ABSTRACT

The necklace clasp fastener for a string of beads consists of a male bead member, and a female bead member, that do not have any visible loop or eyelets for assembling and holding a string of beads together when the male and female bead members are snapped together. The resulting bead configured clasp is almost undetectable from the outside of the beaded necklace which creates an unbroken, unified string of beads for a much more aesthetic and beautiful piece of jewelry. The improved clasp of the invention provides a safety feature to guard against breakage. The two parts are designed to snap together with enough force to hold the necklace on the wearer under normal wear and use. If, however, the necklace catches on to something, the clasp will release easily from the wearer instead of breaking the necklace, and releasing the beads all over the place.

3 Claims, 4 Drawing Sheets

AESTHETIC BEADED NECKLACE CLASP

BACKGROUND OF THE INVENTION

The inventor deemed it desirable to design a beaded necklace clasp for joining a string of beads together in a manner so that no unsightly visible loops or eyelets are employed for assembling and holding a string of beads together. It was also deemed desirable to design a beaded necklace clasp that is almost undetectable from the rest of the beaded necklace which creates an unbroken, unified string of beads for a much more aesthetic and beautiful piece of jewelry.

BRIEF SUMMARY OF PREFERRED EMBODIMENTS OF THE INVENTION

The necklace clasp fastener for a string of beads consists of a male bead member, and a female bead member, that do not have any visible loop or eyelets for assembling and holding a string of beads together when the male and female bead members are snapped together. The resulting bead configured clasp is almost undetectable from the outside of the beaded necklace which creates an unbroken, unified string of beads for a much more aesthetic and beautiful piece of jewelry.

In addition, the slightly rounded, slightly half hourglass configuration of the male bead member and a split springy female bead member, permits easy joining and separation of the male and female parts, for closing and opening the beaded clasp. The ends of the conventional necklace string fully enters the clasp fastener through tiny holes in the bead walls where they are tied to the male and female parts, and knotted entirely within the male and female bead members, and thus being hidden from view to keep the unified look of the necklace.

The improved clasp of the invention provides a safety feature to guard against breakage. The two parts are designed to snap together with enough force to hold the necklace on the wearer under normal wear and use. If, however, the necklace catches on something, especially if the user is bending over, the clasp will release easily from the wearer instead of breaking the necklace, and releasing the beads all over the place.

BRIEF DESCRIPTION OF THE DRAWINGS

Other features and advantages of the invention will become more apparent upon further reading of the specification in conjunction with the drawings in which.

DETAILED DESCRIPTION OF PREFERRED EMBODIMENTS OF THE INVENTION

Figure 1:
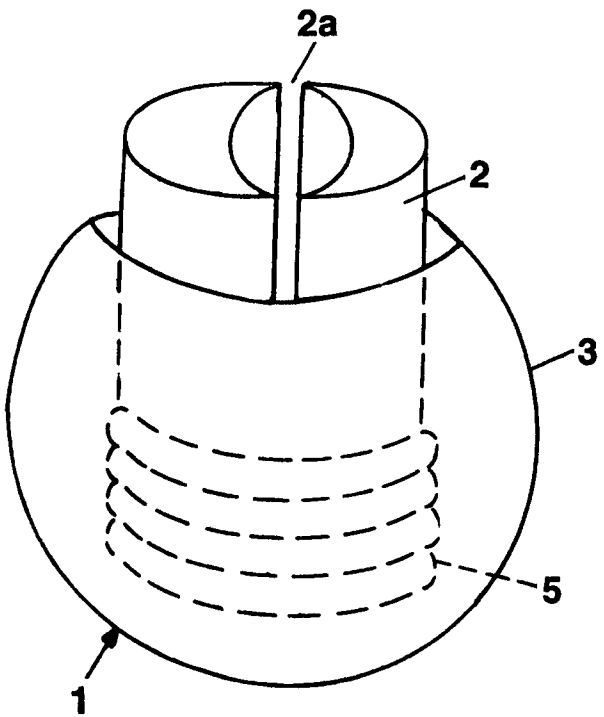
FIG. 1 is a view of the female part force fitted into a bead which has a drilled hole therein.

Referring now to FIG. 1, a female part 2 is inserted into a bead 3 by a force fit within a drilled hole at portion 5 to form the female bead clasp member 1. The female part 2 has a split flexible receptor 2*a* as shown for receiving and holding a male part of the male bead clasp member 4 of FIG. 2.

The male bead clasp member 4 has a stud part 6 with a slightly rounded terminal portion 7 and a slight half hour glass portion 8. The stud part is force fitted into hole 11 formed in bead 9.

Figure 2:
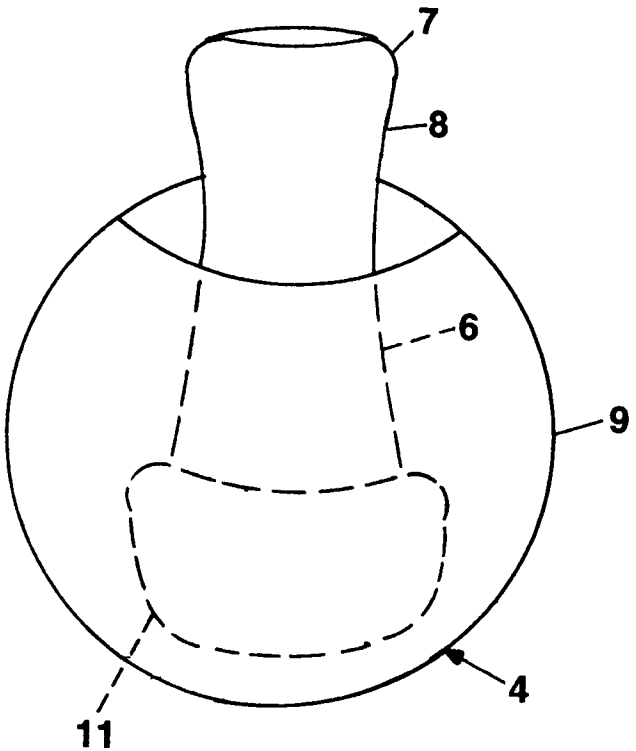
FIG. 2 is a view of the male part force fitted into a bead which has a drilled hole therein.
Figure 3:
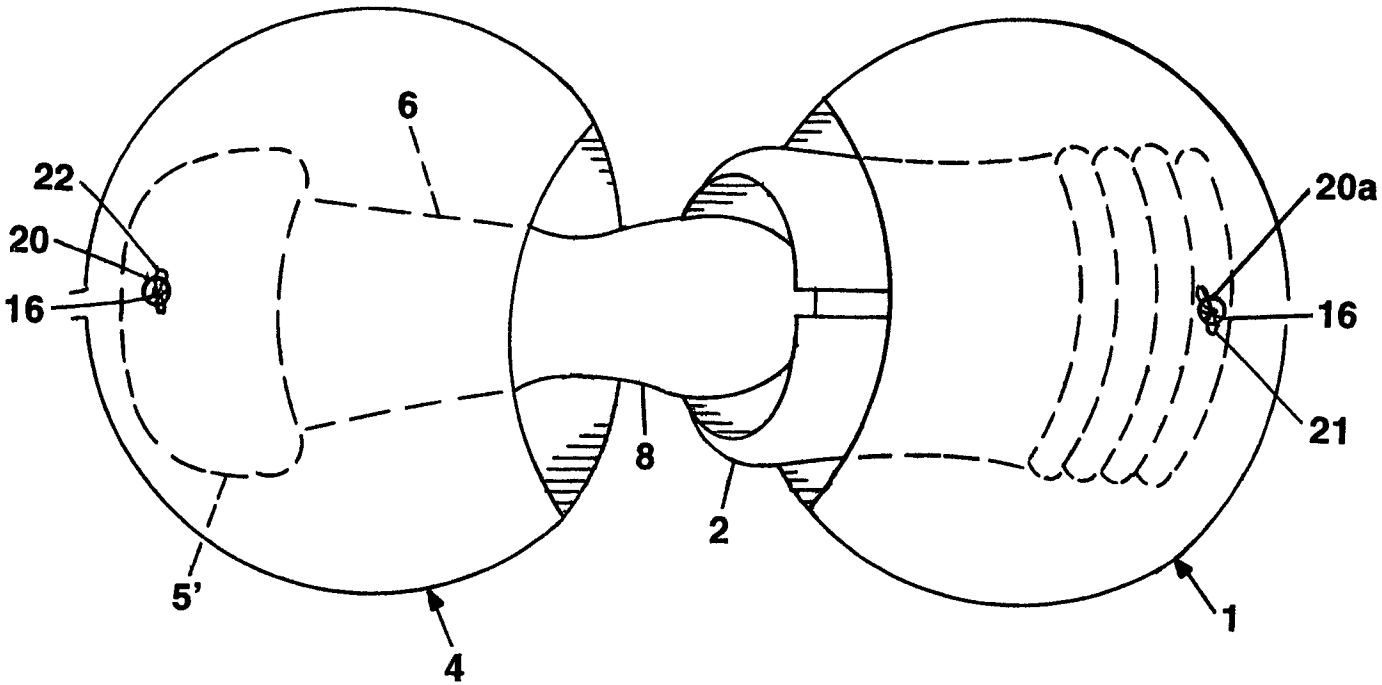
FIG. 3 is a view of the male bead clasp portion being inserted into the female receptor portion of the female bead clasp.

FIG. 3 is a view of the male bead clasp member 4 of FIG. 2 being inserted into the female bead clasp member 1 of FIG. 1. The slight half hourglass shape 8 and the slightly rounded terminal portion 7 (FIG. 2) of the male bead clasp allows the male stud 6 to easily enter the female split flexible receptor part 2 of the female bead clasp member 1. The female clasp opens easily to allow the male stud in, then closes back around the thinner neckline portion 6 of the male bead clasp member, snapping and locking it securely into place.

The clasp of the invention permits easy manual joining and separation of the male and female bead clasp members due to the aforesaid shapes of the components.

Figure 4:
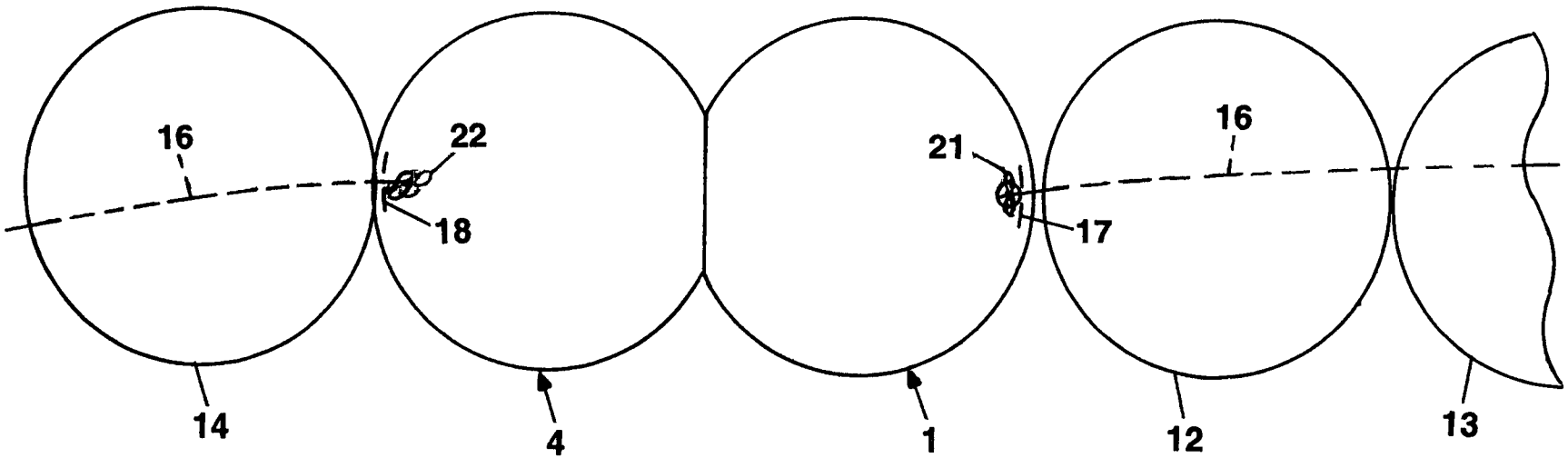
FIG. 4 shows the clasp when the male part is completely inserted into the female part which closes the clasp entirely and creates a beaded clasp that blends into the seamless string of beads.
Figure 6:
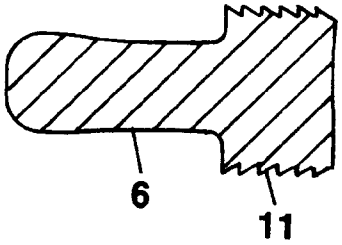
FIG. 6 shows a sectional view through FIG. 5.

FIG. 4 shows the male and female bead clasp members after the aforesaid stud 6 of the male bead clasp member is fully inserted into the female split flexible receptor 2 which closes the clasp entirely and creates a beaded clasp and seamless string of beads as shown in FIG. 4. Except for the very slight flatness where the two beads come together, it is difficult for the average observer to tell that the beaded necklace contain a conspicuous clasp that differs from the rest of the beads in the string of beads, which is an important benefit of the present invention displaying heightened beauty.

FIG. 4 shows a first terminal portion of string 16 passing through beads 12, 13 and terminating within the female clasp member 1.

A first tiny orifice 17 within a wall portion of the first bead clasp member 1 receives a first end of string 16 holding a string of beads together and wherein the first end of the string passes through orifice 17 and is completely knotted within the first bead clasp member at 21.

A second tiny orifice 18 within a wall portion of the second bead clasp member receives the second opposite end of string 16 holding the string of beads together and wherein the second end of string 16 passes through the second orifice 18 and is completely knotted within the second bead clasp member at portion 22.

The knotted ends 21 and 22 of the string could be actually tied to the male and female parts via holes 20 and 20*a* therein as shown in FIG. 3, or merely loosely knotted against the inside walls of the beads as shown in FIG. 4.

Figure 5:
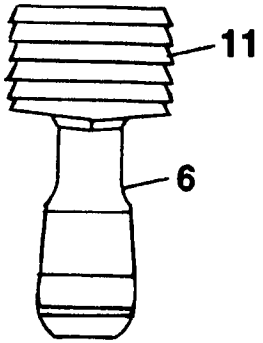
FIG. 5 shows a plan view of the male protrusion part.

FIGS. 5-8 are derived from engineering drawings made in preparation of production of the beaded clasp. FIG. 5 and sectional FIG. 6 taken through FIG. 5 show the aforesaid slightly half hourglass shaped male part which is unique and allows a snug fit into the female part shown in FIGS. 7 and 8, that includes the aforesaid flexible receptor 2 and slit 2*a*.

Portions 11 and 11 a are back ends of the male and female parts which are inserted into the drilled beads which are drilled just large enough that the back ends fits snuggly without the aid of any adhesives or glue. This allows one of the male or female parts to be pushed out with the aid of a small metal tool passed through the aforesaid orifices 17 and 18 of FIG. 4, allowing the necklace to be restrung at any time should it need it, or allowing the parts to be removed and used in other beads without injury or damage to either the beads or the clasp.

Figure 7:
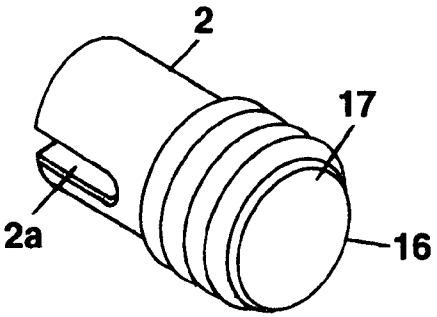
FIG. 7 shows a perspective view of the female receptor part.

FIG. 7 shows the aforesaid side wall 2 of the female part of FIG. 3 which is preferably made of a strong, smooth yet flexible plastic preferably of a combination of glass and nylon.

A preferred Glass filled Nylon available on the market constitutes

A crystalline thermoplastic polymer with properties that include outstanding wear and abrasion resistance, high in use service temperature, excellent impact resistance, excellent chemical resistance, low friction and self lubricating. Polyamides are generally easy to machine. Comes in many different grades. 30% Glass Filled provides increase strength and dimensional stability as well as cuts down expansion due to water absorption.

Figure 8:
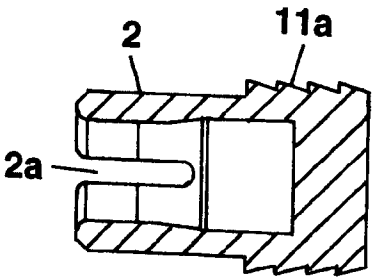
FIG. 8 shows a sectional view through FIG. 7.

FIG. 7 and sectional FIG. 8 taken through FIG. 7 shows the aforesaid slit 2*a* of FIG. 1 which extends part way down the aforesaid female side wall 2 (on both sides) that allows additional flexibility when the rounded male part is inserted. This allows the female part to open around the male part (see FIG. 3) then close snuggly holding the male in place securing the bead and/or necklace.

The following discussion is believed appropriate regarding the somewhat pertinent prior art U.S. Pat. Nos.: Potter 1,795,674; Davis 3,357,204; Charles U.S. Pat. No. 3,066,501.

In Potter's design, the stud extends beyond the confines of the body of the bead, and is unsightly and visible to the eye and the wearer.

In addition, Potter's design appears to require the user to rotate the members in order to fasten them. Our design improves upon this by simply allowing the two parts to literally snap together and stay together without any required rotation. As stated above, the male part is slightly rounded and slightly hourglass shaped, and the female is flexible and has a split part way down the middle to open and allow the male part in, then closes and reshapes around the male part to create a snug fit and audible snap or click securely holding the male part in place. This insures a better, snugger, fit, and allows the necklace to be sturdy and stay in place during normal use, but can also be easily removed by the wearer with just the right amount of tugging or pressure on the necklace.

The clasp of the present invention provides a safety feature to guard against breakage. The two parts are designed to snap together with enough force to hold the necklace on the wearer under normal wear and use. If, however, the necklace catches on something, especially if the user is bending over, the clasp will release easily from the wearer instead of breaking the necklace, and releasing the beads all over the place.

The Charles and Davis disclosures are not for single clasps, but rather for entire necklaces created by a series of beads that have been chained by connecting the beads using a male & female parts that join together continuously. To accommodate this chaining effect of the necklace, the beads must come together in a way that allows both movement and flexibility so the beads are able to bend enough to prevent breakage of the necklace and allow it to lay flat while worn around the neck. This means the beads cannot be so tightly joined as to hide the male part, and the mechanics of how the beads are joined together is clearly visible to the naked eye and the wearer.

In addition, in both Charles and Davis the male parts are placed on the outside of the beads and then joined to the female part of the next bead creating the continuous chaining effect. This also means the male part is always visible to the naked eye and wearer. Our clasp is simply a male and female part placed on the inside of a rounded stone that has been cut into two halves. Each half is then drilled part way to create a shallow hole in which a either a male part or female part is inserted. When the two halves are snapped together, they are completely hidden and tightly held together so that there is no movement or play in the two halves. Our two halves snap together to create one whole bead that entirely contains and hides the male and female parts and creating a seamless experience for the necklace and the wearer.

Our clasp is not intended to be strung together in a chain, but it is intended to be attached to the ends of a necklace of beads strung on silk or other natural or synthetic fibers and used as a single clasp to hold this necklace onto the wearer's neck while completely hiding from view the fact that there is even a clasp on the necklace. The bead that contains the clasp would be identical to the rest of the beads strung onto the necklace, and when closed appears to be just one more bead in the strand. Our clap becomes almost completely invisible to the naked eye and the wearer. Our clasp is also attached to the rest of the strand by thread.

Charles and Davis both require movement at the joints of their male and female parts. Our clasp has no movement once it is closed. Charles' and Davis' designs prohibit the beads from being so tightly snapped together that there is no movement. Their designs require angular movement between the beads in order to allow the chained beads to lay flat on a wearer's neck. Charles' design specifies "Relative angular movement of the two beads is possible provided the socket is sufficiently large to permit free play of the head in the socket or provided the neck carrying the head is flexible. Preferably the head, neck and socket are proportioned to allow relative movement between the two beads such that the axis of the neck and socket may be moved up to 30° out of alignment without restraint."

The fastener of the present invention cells for a stud, or male body member, and a female part that do not have any visible loop or eyelets for attaching the string, but are instead entirely contained with the bead itself (except the stud of the male part) and so when the beads are snapped together, the clasp is almost undetectable from the outside of the beads. It creates an unbroken, unified string of beads for a much more aesthetic and beautiful piece of jewelry.

In addition, Davis needed to prevent his beads from coming apart and states, "once completely forced therein, as shown in FIG. 2, the convolutions 38 bite into the inner surface of the tubular body and prevent separation of the parts 18 and 30." Our improved fastener is created preferably with a smooth body made of a mix of glass and plastic that allows the male and female parts to slip smoothly into and out of each other easily yet. The female shape has been improved to be flexible, yet strong, with a split part way down both sides that allow the slightly hourglass shaped male part to slide in, and then snaps around the male part securely holding it in place while the necklace is worn. When the user gently applies pressure to remove the necklace, the smooth materials, and hourglass shape of the female, allow the two parts to gently come apart without impacting the stability of the clasp or diminishing its use over time. Our improved design allows the clasp to be opened and closed over 500 times and still maintain its snug fit while being worn.

Our improved clasp provides a safety feature to guard against breakage. The two parts are designed to snap together with enough force to hold the necklace on the wearer under normal wear and use. If, however, the necklace catches on something, especially if the user is bending over, the clasp will release easily from the wearer instead of breaking the necklace, and releasing the beads all over the place.

While the invention has been described in connection with preferred embodiments, the description is not intended to limit the scope of the invention to the particular forms set forth, but on the contrary, it is intended to cover such alternatives, modifications, and equivalents as may be included within the spirit and scope of the invention as indicated by the language of the appended claims.

The term "bead" as used herein is intended to cover any small at least somewhat rounded object.

We claim:

1. A bead configured necklace clasp fastener for a string of beads having (a) a first bead clasp member having a beaded configuration, and a second bead clasp member having a beaded configuration, said first and second bead clasp members being shaped to be manually attachable and detachable from one another;

(b) a first tiny orifice within a wall portion of said first bead clasp member for receiving a first end of a string holding a string of beads together and wherein said first end of said string passes through said first orifice and is completely knotted within said first bead clasp member and thus being hidden from view to keep the unified look of the necklace; and (c) a second tiny orifice within a wall portion of said second bead clasp member for receiving a second opposite end of said string holding a string of beads together and wherein said second end passes through said second orifice and is completely knotted within said second bead clasp member and thus being hidden from view to keep the unified look of the necklace; and (d) wherein said first bead clasp member has a male protrusion shaped portion and said second clasp member has a female receptor shaped portion for receiving said male protrusion shaped portion therein; and (e) wherein said female bead clasp member has a split flexible receptor member for receiving and holding the protrusion shaped portion of said male bead member therein.

2. A bead configured necklace clasp fastener for a string of beads having (a) a first bead clasp member having a beaded configuration, and a second bead clasp member having a beaded configuration, said first and second bead clasp members being shaped to be manually attachable and detachable from one another;

(b) a first tiny orifice within a wall portion of said first bead clasp member for receiving a first end) of a string holding a string of beads together and wherein said first end of said string passes through said first orifice and is completely knotted within said first bead clasp member and thus being hidden from view to keep the unified look of the necklace; and (c) a second tiny orifice within a wall portion of said second bead clasp member for receiving a second opposite end of said string holding a string of beads together and wherein said second end passes through said second orifice and is completely knotted within said second bead clasp member and thus being hidden from view to keep the unified look of the necklace; and (d) wherein said first bead clasp member has a male protrusion shaped portion and said second clasp member has a female receptor shaped portion for receiving said male protrusion shaped portion therein; and (e) wherein said string is tied to said male protrusion female receptor shaper portion;

(f) and wherein said female bead clasp member has a split flexible receptor member for receiving and holding the protrusion portion of said male bead member therein.

3. A bead configured necklace clasp fastener for a string of beads having (a) a first bead clasp member having a beaded configuration, and a second bead clasp member having a beaded configuration, said first and second bead clasp members being shaped to be manually attachable and detachable from one another, (b) a first tiny orifice within a wall portion of said first bead clasp member for receiving a first end of a string holding a string of beads together and wherein said first end of said string passes through said first orifice and is completely knotted within said first bead clasp member and thus being hidden from view to keep the unified look of the necklace; and (c) a second tiny orifice within a wall portion of said second bead clasp member for receiving a second opposite end of said string holding a string of beads together and wherein said second end passes through said second orifice and is completely knotted within said second bead clasp member and thus being hidden from view to keep the unified look of the necklace; and (d) wherein said first bead clasp member has a male protrusion shaped portion and said second clasp member has a female receptor shaped portion for receiving said male protrusion shaped portion therein; and (e) wherein said male protrusion shaped portion is slightly rounded and has a slightly half hourglass configuration;

(f) and wherein said female bead clasp member has a split flexible receptor member for receiving and holding the protrusion portion of said male bead member therein.

* * * * *